United States Patent [19]

Hewlitt

[11] 3,954,135

[45] May 4, 1976

[54] GAS TURBINE ENGINE REGENERATOR SEAL ASSEMBLY WITH FLOATING LEAF SEALING ELEMENT

[75] Inventor: Robert W. Hewlitt, Cedar Falls, Iowa

[73] Assignee: Deere & Company, Moline, Ill.

[22] Filed: Dec. 4, 1974

[21] Appl. No.: 529,406

[52] U.S. Cl. ..... 165/9; 60/39.51 H
[51] Int. Cl.[2] ..... F23L 15/02; F02C 7/10
[58] Field of Search ..... 60/39.51 H; 165/9; 277/95, 96 R, 96 A, 96 B

[56] References Cited

UNITED STATES PATENTS

| | | | |
|---|---|---|---|
| 3,622,737 | 11/1971 | Trodeau | 165/9 |
| 3,743,008 | 7/1973 | Zeek et al. | 165/9 |
| 3,761,101 | 9/1973 | Good et al. | 165/9 |

*Primary Examiner*—Carlton R. Croyle
*Assistant Examiner*—L. J. Casaregola
*Attorney, Agent, or Firm*—Fraser and Bogucki

[57] ABSTRACT

A three part seal assembly for sealing the rotatable disk regenerator of a gas turbine engine is disclosed. Each part of the seal assembly generally includes a base having one side carrying low friction means for engaging the regenerator and another side carrying a spring mechanism for making sealing contact with a surface on the engine housing and urging the low friction means into sealing engagement with the regenerator. One part of the seal assembly is in the form of a linear crossbar having a spring mechanism including generally parallel, longitudinally extending spring and retainer members. Each of these members has a first portion affixed to the base and a second portion extending away from the base in cantilever fashion. The cantilevered, second portions of the spring and retainer members are in parallel, spaced-apart relation. A relatively thin, resilient, floating sealing element is loosely constrained between the second portions of the spring and retainer, the sealing element having a sealing edge extending beyond the spring and retainer for sealing engagement with the engine housing. This floating seal arrangement avoids crimping or rippling of the resilient seal element under forces produced by the high temperatures and pressures present during engine operation thereby maintaining the integrity of the seal.

8 Claims, 6 Drawing Figures

GAS TURBINE ENGINE REGENERATOR SEAL ASSEMBLY WITH FLOATING LEAF SEALING ELEMENT

BACKGROUND OF THE INVENTION

1. Field of the Invention

This invention relates generally to multi-part seal assemblies and particularly to a multi-part seal assembly adapted for use in sealing the rotatable regenerator of a gas turbine engine.

2. Description of the Prior Art

Special seals have been developed for heavy duty applications such as sealing regenerators in gas turbine engines where the seal is subjected to high pressures and high temperatures. Such seals may have multiple parts loosely joined to allow for thermal expansion and construction. One such seal structure, shown in U.S. Pat. No. 3,761,101 comprises two arcuate portions joined at their ends and a linear crossbar portion extending between the joinder points of the arcuate portions. Each part of the seal includes a relatively thin, flexible base having a high temperature, low friction contact means on one side thereof for sealing engagement with the movable regenerator and a leaf spring mechanism affixed to the other side thereof for making sealing engagement with the engine housing. Where pressure differentials are not extreme, the spring mechanism may simply consist of a single, relatively thin, resilient leaf spring sealing element including a cantilevered portion having a sealing edge for engaging the housing. Where required by greater pressure differentials, the sealing element may be reinforced by a somewhat thicker and stronger leaf spring having a shape which generally conforms to the shape of the sealing element.

Such arrangements work relatively well along the curvilinear portions of the seal assembly which are capable of adjusting to thermal expansion or contraction by varying the angle at which the leaf spring mechanism is cantilevered with respect to the base. However, such compensation is not possible along the linear, crossbar portion of the seal assembly. It has been observed that the differences in the expansions (and contractions) of the sealing element on the one hand, and the base and reinforcing leaf spring member on the other eventually result in permanent deformation, in the form of rippling, of the sealing element thereby destroying the integrity of the seal. The sealing element must thus be replaced after each period of operation and renders the engine unsuitable for applications, such as in the automotive field, where the engine is subject to intermittent starting and stopping.

SUMMARY OF THE INVENTION

Broadly, the present invention comprises a multi-part gas turbine engine regenerator seal assembly having a generally linear, crossbar portion including a leaf spring sealing mechanism having cantilevered, spaced-apart spring and retainer members carrying between them, in loosely constrained fashion, a floating sealing element. The floating seal arrangement of the invention is such that it allows differential expansions (and contractions) of the various parts of the sealing mechanism to take place without causing distortion or rippling of the sealing element.

In accordance with one specific, exemplary embodiment of the invention, there is provided a seal assembly for sealing the rotatable disk regenerator of a gas turbine engine which assembly includes a pair of curvilinear seal subassemblies loosely joined at their ends and a linear crossbar seal subassembly extending between, and loosely coupled to, the joinder points of the curvilinear seals. The crossbar seal subassembly includes an elongated, flexible base plate on one surface of which is mounted low friction sealing blocks, of carbon or the like, for sealingly engaging one of the flat, end faces of the regenerator. Secured to the other surface of the base plate is a leaf spring sealing mechanism for sealingly engaging a surface on the engine housing. The sealing mechanism comprises an elongated spring member and an elongated retainer member, the spring and retainer members having first portions attached to the base plate and parallel, spaced-apart second portions diverging from the base plate in cantilever fashion and holding between them, in loosely constrained or floating relation, a thin, elongated resilient sealing element. The sealing element has a sealing edge extending beyond the longitudinal edges of the spring and retainer members and end tabs extending beyond the lateral extremities of the spring member. A keeper mounted on each tab allows limited movement of the sealing element relative to the spring and retainer members.

BRIEF DESCRIPTION OF THE DRAWINGS

A better understanding of the invention may be had from a consideration of the following detailed description taken in conjunction with the accompanying drawings in which.

DETAILED DESCRIPTION

Figure 1:
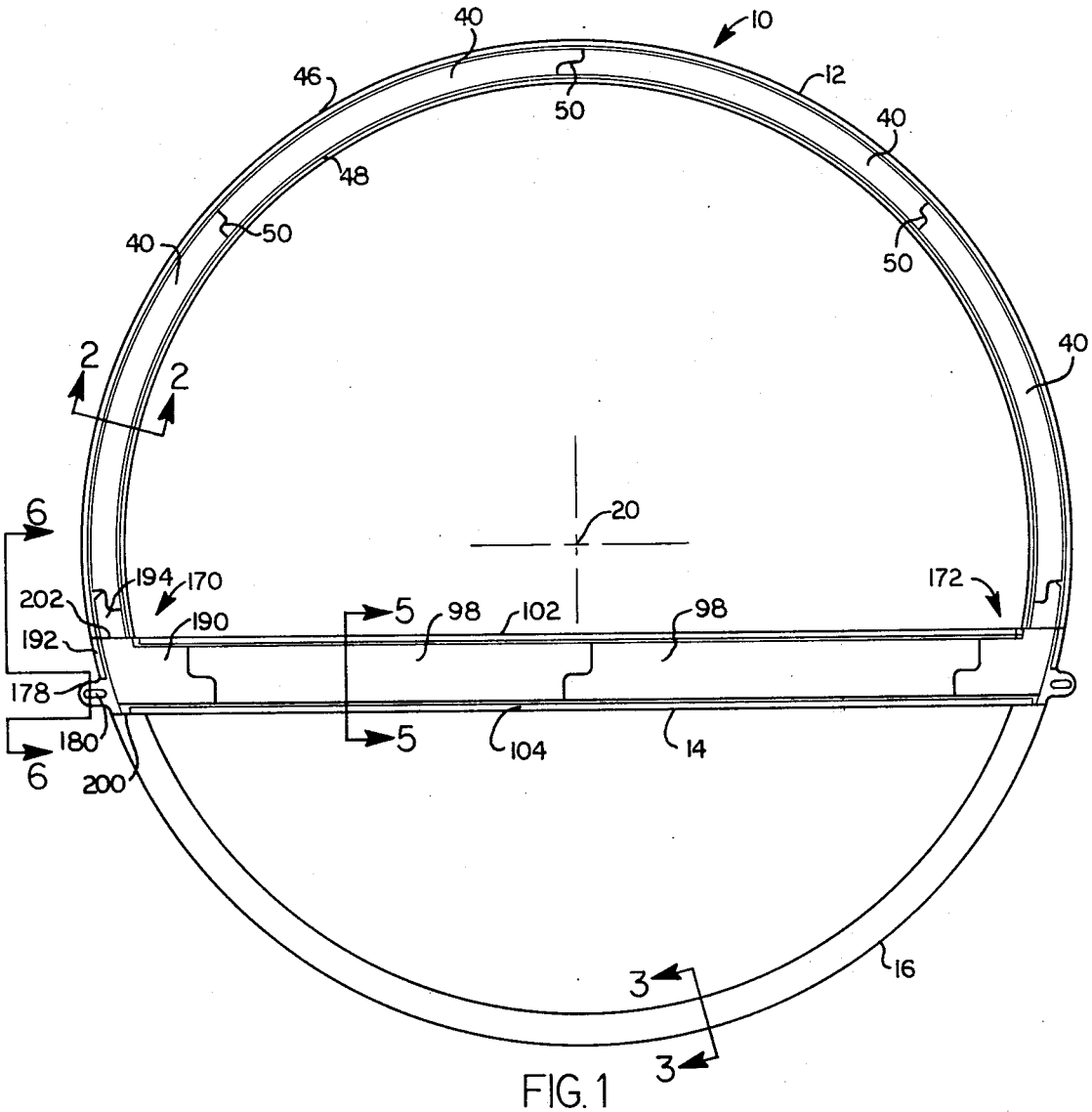
FIG. 1 is an end elevation view of a seal assembly in accordance with the invention as seen from the side thereof which is adapted to engage the rotatable disk regenerator of a gas turbine engine.

As shown in FIG. 1, there is provided a gas turbine regenerator seal assembly 10 including an upper curvilinear subassembly 12, a linear crossbar subassembly 14, and a lower curvilinear subassembly 16. In use, the seal assembly 10 is disposed with the side shown in FIG. 1 against a disk-shaped regenerator (not shown) having a rotational axis 20. The side opposite that shown in FIG. 1 engages suitably shaped surfaces (not shown) of the engine housing.

In operation, medium temperature, high pressure gases pass through the lower portion of the regenerator defined by the crossbar seal 14 and lower seal 16 in a direction coming out of the plane of FIG. 1. As the high pressure gases pass through the lower portion of the regenerator they are heated so that the gases are at a substantially higher temperature as they exit the lower portion of the regenerator and at a slightly lower pressure resulting from the pressure drop across the regenerator. There is therefore only a slight pressure drop across the lower curvilinear seal 16 but a substantial temperature differential. Exhaust gases having a pressure near atmospheric pressure and a temperature of the order of 1200° F. pass through the seal and regenerator at the upper portion thereof between the upper curvilinear seal 12 and crossbar seal 14 in a direction into the plane of FIG. 1. As the exhaust gases pass through the regenerator they are cooled to a temperature of approximately 750° F. It can thus be seen that the seal assembly 10 is subjected to substantial temperature and pressure changes between operating and non-operating conditions as well as substantial temperature and pressure differentials during the course of normal operation.

Figure 2:
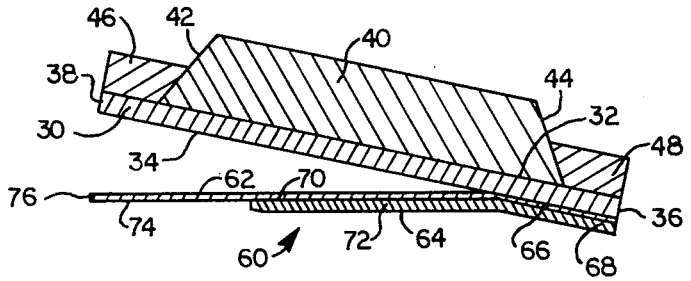
FIG. 2 is a cross-sectional view taken along the line 2—2 in FIG. 1.

Turning now to the structural details of the seal assembly 10, as best shown in FIG. 2 the upper seal subassembly 12 includes a base plate 30 having a regenerator side 32 and an engine housing side 34. The base plate 30 is an elongated, arcuate member having an inner fixed edge 36 and an outer free edge 38.

Low friction, carbon sealing blocks 40 having sloped edges 42 and 44 are held against the side 32 of base 30 by holddowns 46 and 48 secured to the base 30 and engaging sloping edges 42 and 44. The carbon blocks 40 have irregularly shaped mating ends 50 to minimize gas leakage.

A leaf spring mechanism 60, including a thin, resilient, elongated sealing element 62 and a somewhat stiffer, resilient leaf spring member 64, is affixed to the housing side 34 of base plate 30. The sealing element 62 and spring member 64 have first portions 66 and 68, respectively, affixed to the base 30 and second, abutting portions 70 and 72, respectively, extending away from the base 30 in cantilever fashion at a small angle, for example, 11°–12°, with respect to the base. The sealing element 62, which is wider than the spring member 64, has a free or overhanging margin 74 terminating along a sealing edge 76. The edge 76 may be beveled to present a small flat surface adapted to engage the mating surface on the engine housing.

The first portions 66 and 68 of the sealing element 62 and spring member 64 may be suitably affixed to the base 30 by a process such as spot welding with the portions 66 and 68 being adjacent the inner, low pressure edge 36 of base plate 30. The cantilevered portions 70 and 72 open toward the high pressure edge 38 of base 30 such that the pressure differential tends to urge the sealing edge 76 of sealing element 62 into tighter sealing engagement. The flexure of the sealing element 62 and the spring member 64 permit the seal assembly 10 to accommodate small amounts of runout of the regenerator as it rotates. The relatively stiff spring member 64 provides mechanical support for the relatively thin sealing element 62 and by increasing the force of the seal assembly 10 against the regenerator tends to prevent complete closure of the spring mechanism 60 against the base plate 30.

Figure 4:
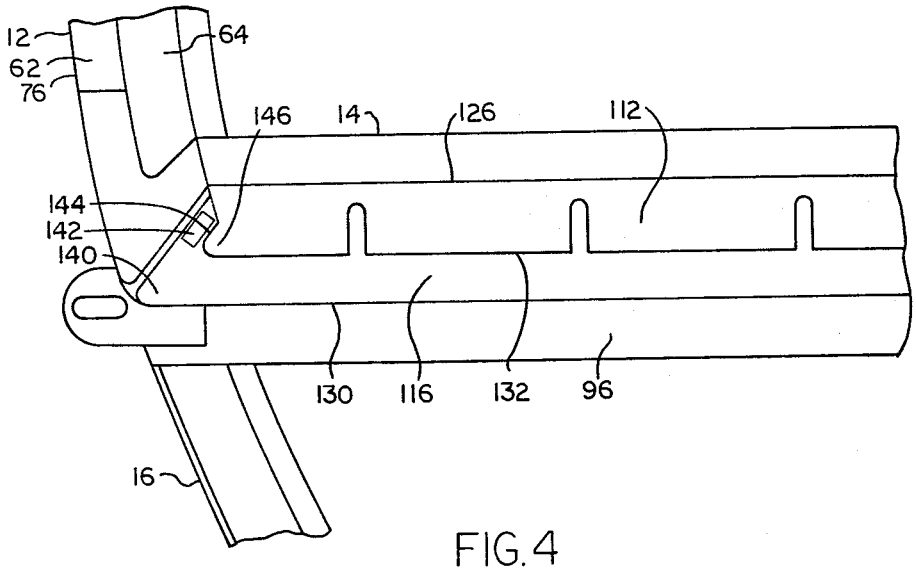
FIG. 4 is an end elevation view of a portion of the seal assembly shown in FIG. 1 as seen from the other side thereof.
Figure 5:
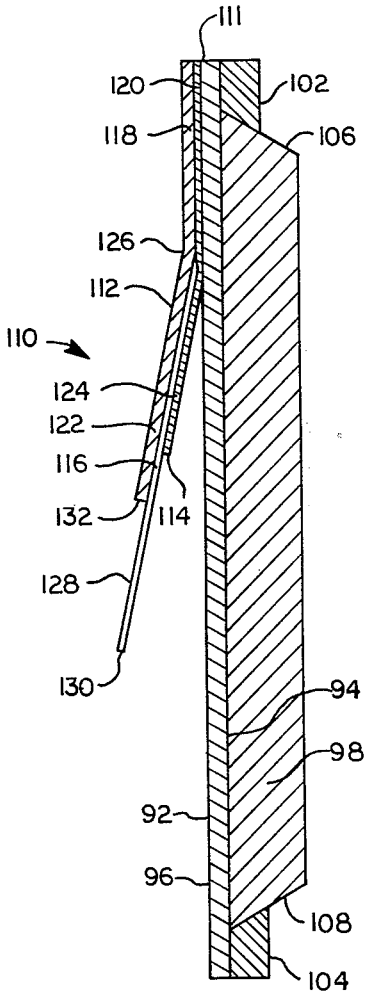
FIG. 5 is a cross-sectional view taken along the line 5—5 in FIG. 1.

The crossbar seal portion 14, which is shown in detail in FIGS. 4 and 5 is a horizontally oriented, straight member which extends across the regenerator somewhat below the axis 20. The construction of the cross member 14 is similar in many respects to that of the upper seal 12 and includes a linear, flexible base plate 92 having a regenerator side 94 and a housing side 96. Disposed along the side 94 are low friction carbon blocks 98 for sealingly engaging the regenerator. Holddowns 102 and 104 secured to the plate 92 engage sloping edges 106 and 108 of the blocks 98 to retain the blocks.

A spring mechanism 110 is affixed to the housing side 96 of base plate 92 along the upper, low pressure edge 111 thereof. Spring mechanism 110 includes abutting, longitudinally extending leaf spring 112, retainer 114 and floating sealing element 116. The leaf spring 112 and retainer 114 have margins 118 and 120, respectively, affixed to the base plate 92, with the retainer margin 120 being interposed between the spring margin 118 and the base plate 92. The spring 112 and retainer 114 further include parallel, spaced-apart cantilevered portions 122 and 124 extending from a bend line 126 and diverging from the base plate 92. The cantilevered portions 122 and 124 are resiliently biased to tend to close the space between them and loosely retain between them, in interleaved fashion, the floating sealing element 116 which can move, within limits, with respect to the spring 112 and retainer 114.

The spring 112 is somewhat thicker and therefore stiffer than the retainer 114 and has a width less than that of the sealing element 116 to define a free, overhanging sealing element portion 128 terminating along a sealing edge 130. The width of the retainer 114 is also less than that of the sealing element 116 and in the embodiment under discussion is slightly narrower than the spring 112, as well. Both the sealing edge 130 of the sealing element 116 and the outermost edge 132 of the spring 112 may be beveled to define flat contact areas for sealingly engaging the mating surfaces of the engine housing.

As best shown in FIG. 4 the lateral extremities of the floating sealing element 116 are shaped to define tabs 140 extending beyond the ends of the spring 112. Keepers 142 are secured to the tabs 140 and cooperate with angularly oriented edges 144 on ears 146 of the spring 112 to allow limited lateral and up and down movements of the sealing element 116, as viewed in FIG. 4, relative to spring 112, retainer 114 and base plate 92. Because the floating sealing element 116 is free to move to some degree with respect to the spring member 112 and retainer member 114, expansion or contraction thereof does not force corresponding changes upon the relatively thin, compliant floating sealing element 116. The contour of the sealing edge 130 thus remains flat throughout multiple operating cycles of the regenerator and no loss of sealing capability is encountered.

Figure 3:
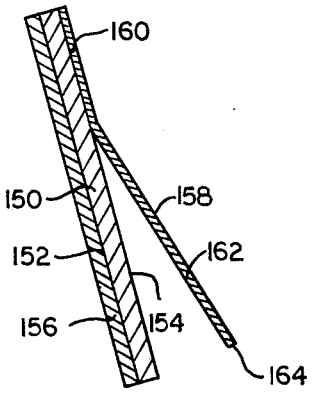
FIG. 3 is a cross-sectional view taken along the line 3—3 in FIG. 1.

The lower seal subassembly 16 of seal assembly 10 is subject to only small differential pressures and may therefore be of somewhat simpler construction as shown in FIG. 3. The portion 16 includes a base plate 150 having a regenerator side 152 and a housing side 154. The regenerator side 152 is coated with a low friction material 156 such as carbon or the like. Affixed to the housing side 154 is a single leaf spring sealing element 158 having a first portion 160 attached to the base plate 150 and a cantilevered portion 162 extending away from the base plate and having a sealing edge 164 for contacting a sealing surface on the engine housing. The sealing element 158, like the elements 62 and 116 of the upper and crossbar seals, is made of relatively thin, lightweight, high temperature spring material. Because of the small pressure differential across the lower seal portion 16, no heavy reinforcing or backing spring is required to provide mechanical support for the sealing element 158.

Figure 6:
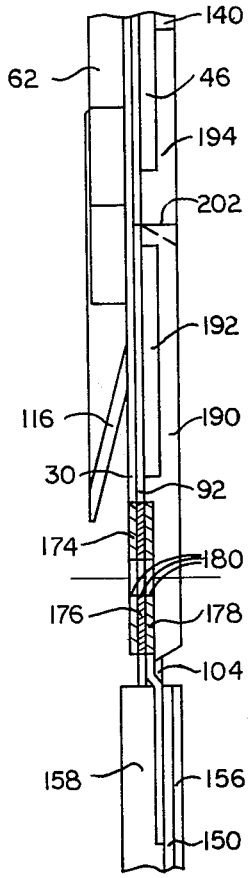
FIG. 6 is a side elevation view, partly in cross-section, taken along the line 6—6 in FIG. 1.

The three seal portions 12, 14 and 16 are loosely coupled at joints 170 and 172 as best shown in FIGS. 1, 4 and 6. These joints permit relative movement of the seal subassemblies to accommodate thermal expansion and contraction of the individual portions. While only the left-hand joint (as shown in FIG. 1) will be described in detail, it will be appreciated that the right-hand joint is substantially the mirror image thereof.

Each base plate 30, 92 and 150 has a lug 174, 176 and 178, respectively, projecting from the end of the base plate. The lugs have laterally-extending slots 180. Upon assembly of the seal portions, lugs 174, 176 and 178 are stacked, as shown in FIG. 6, with the slots 180 in alignment. A loose fitting pin (not shown) is received by the slots 180 and suitably attached to the engine housing.

To prevent leakage at each joint, a carbon end block 190, mating with the leftmost block 98 of the crossbar seal, is provided at the crossbar extremity. The block 190 is held in place vertically by holddowns 102 and 104 and laterally by a short holddown section 192 along the periphery of the seal assembly. Likewise, a short carbon end block 194, mating with the lower extremity of leftmost block 40 of upper seal 12, fills the space between the block 40 and the crossbar end block 190. The short end block 194 is restrained laterally by holddowns 46 and 48.

Between the lower seal 16 and crossbar seal 14 a small pressure differential is encountered and a small amount of leakage at the interface 200 is tolerable. However, between the upper seal 12 and the crossbar seal 14 a very substantial pressure differential is encountered and leakage must therefore be minimized. The short block 194 and end block 190 therefore provide an arrangement such that as the regenerator rotates there is a tendency for any gap at the interface 202 between these two blocks to close and further increase the tightness of the seal at that interface. Further, as best shown in FIG. 6, immediately adjacent the interface 202 between carbon blocks 190 and 194 the base plates 30 and 92 are in overlapping, abutting relationship to further prevent leakage.

What is claimed is:

1. In a gas turbine engine regenerator seal assembly including a pair of curvilinear seal portions loosely coupled at their ends at joinder points and a crossbar seal portion loosely coupled to and extending between the joinder points, and in which the seal portions each comprise a base plate, low friction seal means attached to one side of the base plate for making sealing contact with the regenerator and a leaf spring sealing element associated with the other side of the base plate and having a sealing edge for making sealing contact with a surface of the engine housing, the improvement in which the base plate of the crossbar seal portion carries means for retaining the crossbar sealing element in floating relationship with respect to the base plate and the sealing element retaining means whereby the crossbar sealing element is substantially unaffected by thermal expansion and contraction of the retaining means and base plate, the retaining means including an elongated leaf spring member having a first elongated edge affixed to said other side of the base plate and a second elongated edge opposite the first elongated edge supported in cantilever fashion away from the base plate, the sealing element being disposed adjacent to and being at least partially supported by the spring member with the sealing edge of the sealing element extending beyond the second edge of the spring member.

2. In a gas turbine engine regenerator seal assembly including a pair of curvilinear seal portions loosely coupled at their ends at joinder points and a crossbar seal portion loosely coupled to and extending between the joinder points, and in which the seal portions each comprise a base plate, low friction seal means attached to one side of the base plate for making sealing contact with the regenerator and a leaf spring sealing element associated with the other side of the base plate and having a sealing edge for making sealing contact with a surface of the engine housing, the improvement in which the base plate of the crossbar seal portion carries means for retaining the crossbar sealing element in floating relationship with respect to the base plate and the sealing element retaining means whereby the crossbar sealing element is substantially unaffected by thermal expansion and contraction of the retaining means and base plate, the sealing element retaining means including an elongated leaf spring member and a retainer member, the members having first portions affixed to the base plate and second portions extending from the first portions and away from the base plate in cantilever fashion, the first portion of the retainer member being disposed between the base plate and the first portion of the spring member, the second portions being in parallel, spaced-apart relationship, the sealing element being held between the second portions in floating relationship thereto, the sealing element having a free margin projecting from the second portions of the members.

3. The improvement, as defined in claim 2, in which the leaf spring member has an end adjacent each joinder point and an ear projects from each end, the sealing element having an end tab projecting beyond each end of the spring member, each tab having a keeper attached thereto and operatively associated with the corresponding ear to allow movement of the sealing element, within limits established by the position of the keeper with respect to the ear, relative to the spring member.

4. The improvement, as defined in claim 2, in which the leaf spring member is stiffer than the retainer member and the second portion of the leaf spring member has a width greater than the width of the second portion of the retainer member.

5. In a multi-part gas seal assembly for sealing a rotatable disk regenerator in a gas turbine engine, a linear seal part comprising:

a generally flat, elongated base having a first side carrying low friction seal means adapted to ride in contact with a face of the regenerator, and a second side;

a sealing element holder attached to the second side of the base and including two parallel, flexible, spaced-apart members extending in cantilever fashion away from the base; and a floating sealing element having a portion disposed between the spaced-apart members and a free margin projecting from said members, the margin having an edge adapted to sealingly engage a surface of the housing of the engine.

6. The gas seal assembly according to claim 5, in which the two spaced-apart members are resiliently biased to decrease the space between them.

7. The gas seal assembly according to claim 5, which further comprises means for limiting the motion of the floating sealing element relative to the two spaced-apart members.

8. In a multi-part gas seal assembly for sealing a rotatable disk regenerator in a gas turbine engine, a linear seal for sealing one portion of the regenerator from another portion thereof, comprising:

a generally flat, elongated, flexible base plate having a first side carrying low friction means adapted to ride in contact with a face of the regenerator, and a second side; and a leaf spring mechanism attached to the second side of the base plate for resiliently biasing the base plate toward the face of the regenerator, the spring mechanism including (a) an elongated spring member having a first portion thereof affixed to the base plate and a second portion extending in cantilever fashion from the first portion, the second portion being bounded by an edge which is spaced from the base plate, (b) an elongated retainer member having a first portion thereof affixed to the base plate and a second portion extending in cantilever fashion from the first portion, the second portion of the retainer member being disposed in generally parallel, spaced-apart relation to the second portion of the spring member and being bounded by an edge which is spaced from the base plate, the second portions of the spring member and retainer member being biased to tend to close the space between them, (c) an elongated floating sealing element having an inner margin disposed between the second portions of the spring member and retainer member and an outer margin projecting in cantilever fashion beyond the edges of the second portions of the spring and retainer members and having an edge for sealingly engaging a surface on the engine housing, and (d) means for limiting the movement of the floating sealing element relative to the spring member including tabs projecting from the ends of the sealing element, ears projecting from the end of the spring member and a keeper affixed to each tab and disposed relative to the corresponding ear to permit limited movement of the sealing element.

* * * * *

UNITED STATES PATENT OFFICE

CERTIFICATE OF CORRECTION

Patent No. 3,954,135 Dated May 4, 1976

Inventor(s) Robert W. Hewlitt

It is certified that error appears in the above-identified patent and that said Letters Patent are hereby corrected as shown below:

Column 2, line 64, "coming out of" should read --into--. Column 3, line 9, "into" should read --coming out of--. Column 5, between lines 42 and 43 insert the following paragraph:

--While there has been shown and described above a particular embodiment of a gas turbine engine regenerator seal assembly with floating leaf sealing element for the purpose of enabling a person of ordinary skill in the art to make and use the invention, it should be appreciated that the invention is not limited thereto. Accordingly, any modification, variations or equivalent arrangements within the scope of the appended claims should be considered to be within the scope of the invention.--

Column 8, line 19, after "each" and before "tab" insert --end--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*